US005716237A

United States Patent [19]

Conorich et al.

[11] Patent Number: 5,716,237

[45] Date of Patent: Feb. 10, 1998

[54] ELECTRICAL CONNECTOR WITH CROSSTALK COMPENSATION

[75] Inventors: Theodore Alan Conorich, Parsippany; Michael Gregory German, Secaucus, both of N.J.; Amid Ihsan Hashim, West Hartford, Conn.

[73] Assignee: Lucent Technologies Inc., Murray Hill, N.J.

[21] Appl. No.: 673,711

[22] Filed: Jun. 21, 1996

[51] Int. Cl.[6] ..... H01R 19/00

[52] U.S. Cl. ..... 439/660; 439/701; 439/941

[58] Field of Search ..... 439/941, 660, 439/608, 701

[56] References Cited

U.S. PATENT DOCUMENTS 5,151,036 9/1992 Fusselman et al. ..... 439/608
5,547,405 8/1996 Pimmey et al. ..... 439/941

*Primary Examiner*—Neil Abrams
*Assistant Examiner*—T. C. Patel
*Attorney, Agent, or Firm*—Lester H. Birnbaum

[57] ABSTRACT

Disclosed is an electrical connector which compensates for near-end crosstalk at its mating section with near-end crosstalk of an opposite polarity and essentially equal magnitude. Conductive plates connected to the conductors provide capacitive coupling unbalance between the adjacent pairs to produce the necessary opposite polarity, equal magnitude near-end crosstalk.

7 Claims, 5 Drawing Sheets

ELECTRICAL CONNECTOR WITH CROSSTALK COMPENSATION

FIELD OF THE INVENTION

This invention relates to electrical connectors, and in particular to connectors which include crosstalk compensation.

BACKGROUND OF THE INVENTION

Standards for crosstalk in connectors has become increasingly stringent. For example, in category 5 of ANSI/TIA/EIA-568A Standard, it is required that a connector exhibit pair to pair near-end crosstalk loss which is better than 40 dB at 100 MHz. Since a 25 pair miniature ribbon connector is designed to carry the signals for a multitude of work stations, this requirement has to be met on a power sum basis. This is a more stringent requirement since for each pair, crosstalk couplings from all the other pairs must be considered.

Recently, it has been proposed to produce a category 5 connector by inclusion of conductors in a side-by-side relation to provide crosstalk of a polarity opposite to that of the mating section of the connector. (See U.S. patent application Ser. No. 08/263,111 filed Jun. 21, 1994, now U.S. Pat. No. 5,562,479.) It has also been proposed to reduce crosstalk, for example in modular jacks, by crossing over certain conductors. (See U.S. Pat. No. 5,186,647 issued to Denkmann et al.) It has also been suggested that certain conductors in a modular jack could be mounted above certain other conductors to provide capacitive coupling and thereby induce opposite polarity crosstalk. The conductors could be formed as lead frames or printed on a printed circuit board. (See British Patent No. 2,271,678 issued to Pinhey et al.)

Thus, while category 5 performance has been achieved for certain types of connectors, it does not appear that such performance has been realized for a multi-pair, e.g., 25 pair, printed wiring board connector. Rather, existing 25 pair printed wiring board connectors generally exhibit near-end crosstalk of 28–32 dB at 100 MHz using the power sum measurement.

SUMMARY OF THE INVENTION

The invention is a connector comprising a plurality of pairs of first and second conductors arranged in a row. Each pair has a mating section for electrical connection to another connector so that the first and second conductors receive signals of opposite polarities. Each conductor of the pair in the mating section is in spaced vertical alignment with the other conductor of the pair, and like conductors in each pair are in horizontal alignment. The mating section produces crosstalk of a first polarity when a signal is supplied thereto. Conductive plates extend vertically from at least one conductor of at least selected pairs. The plate of a first conductor is spaced from a plate of a second conductor in an adjacent pair to provide capacitive coupling therebetween causing capacitive coupling unbalance between the pairs when a signal is applied thereto in order to produce near-end crosstalk of a polarity opposite to that produced by the mating section.

BRIEF DESCRIPTION OF THE FIGURES

These and other features of the invention are delineated in detail in the following description. In the drawing.

DETAILED DESCRIPTION

Figure 1:
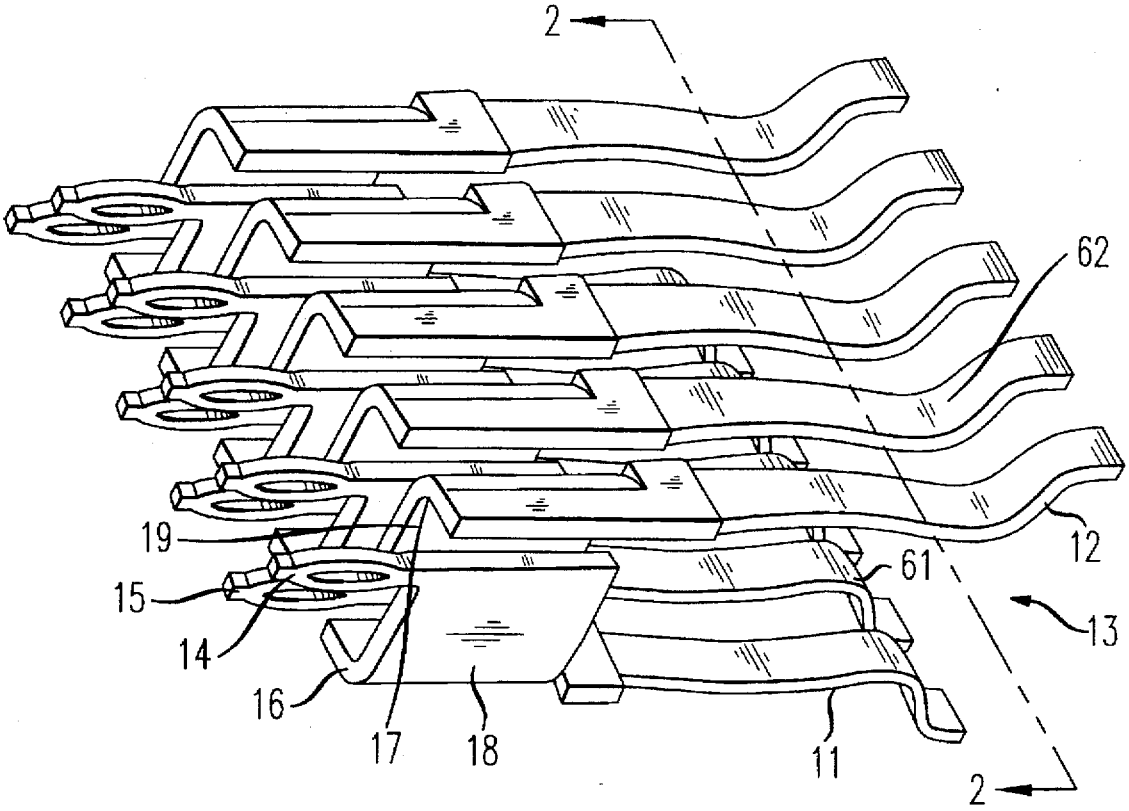
FIG. 1 is a perspective view of a plurality of conductor pairs in accordance with an embodiment of the invention.

Referring now to the drawings, in which like reference numerals identify similar or identical elements, FIG. 1 illustrates a plurality of conductor pairs which are mounted within a connector housing as described in more detail below. The housing is not shown in this figure for the sake of clarity in describing the invention. While 5 conductor pairs are shown, the connector would typically include several more pairs, a 25 pair connector being the most common.

Each conductor pair includes a first conductor, 11, and a second conductor, 12, which will comprise a tip (T) and ring (R) conductor for the connector. The conductors are shaped to form a mating section, 13, at one end for receiving another connector (not shown) such as a standard 25 pair cable connector. It will be noted that in the mating section, the two conductors, 11 and 12, are in a spaced vertical alignment. At the opposite end, each conductor, 11 and 12, is formed into a terminating tail, 14 and 15 respectively, for example laterally offset press-fit eyelets for mounting on printed wiring boards or insulation displacement contacts for attaching to a cable.

Between the two ends, the conductors, 11 and 12, are shaped into generally L-shaped portions, 16 and 17, respectively, to form facing vertically extending plates, 18 and 19, respectively. These plates, 18 and 19, act as capacitor plates when a voltage is supplied to the conductors. Although the plates are shown as integral with the conductors, they could be separate elements physically attached to the conductors. Further, although the plates are preferably formed on each conductor of each pair, these may be applications where only selected pairs or selected conductors in a pair include such plates.

Figure 2:
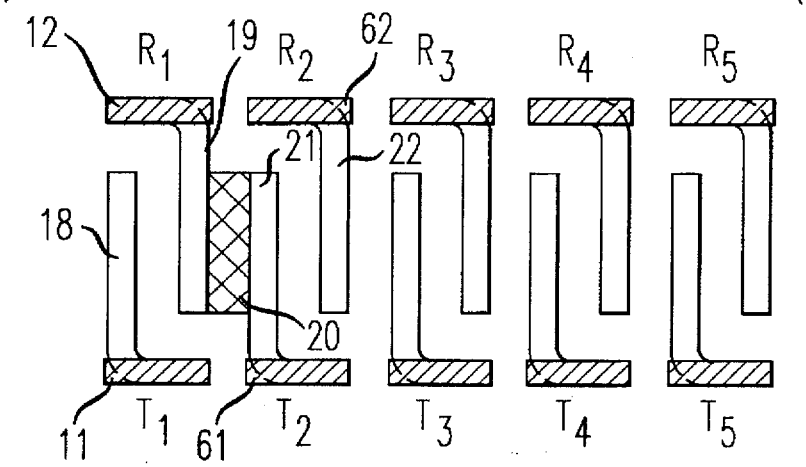
FIG. 2 is a cross sectional, partly schematic view taken along line 2—2 of FIG. 1 illustrating certain principles of the invention.

FIG. 2 illustrates some of the basic principles of the invention. In this figure, all tip conductors, e.g., 11, in the plurality of pairs are aligned in a horizontal row and are labelled $T_1$ to $T_5$, while all ring conductors, e.g., 12, are also aligned in a vertically spaced horizontal row and are labelled $R_1$ to $R_5$. Since, during operation of the connector, the vertical plates, e.g., 18 and 19, act like capacitor plates, capacitive coupling will take place between each conductor, e.g., $R_1$ of one pair and an adjacent unlike conductor, e.g., $T_2$ of the adjacent pair. One such region of capacitive coupling, 20, is illustrated schematically by cross hatching. Similar capacitive coupling, though diminished, will also take place between the conductor, $R_1$ and the unlike conductor, $T_3$ in the next pair.

Thus, while near-end crosstalk of a certain polarity and magnitude is produced during the operation of the connector in the mating section, 13 of FIG. 1, between adjacent Tip conductors and between adjacent Ring conductors as the result of the orientation of the conductors, e.g., 11 and 12, in that section, near-end crosstalk of an opposite polarity is produced due to the capacitive coupling unbalance between adjacent and next adjacent pairs resulting from the presence of the vertical plates, e.g., 18, 19, 21 and 22. (As understood in the art, the term "capacitive coupling unbalance" describes the total capacitive coupling between two pairs contributing to differential crosstalk, i.e., the difference between capacitive coupling between unlike conductors in the pairs and the capacitive coupling between like conductors in the pairs). By adjusting the size and spacing of the vertical plates, the opposite polarity near-end crosstalk can be made to essentially cancel out the near-end crosstalk produced in the mating section.

Figure 3:
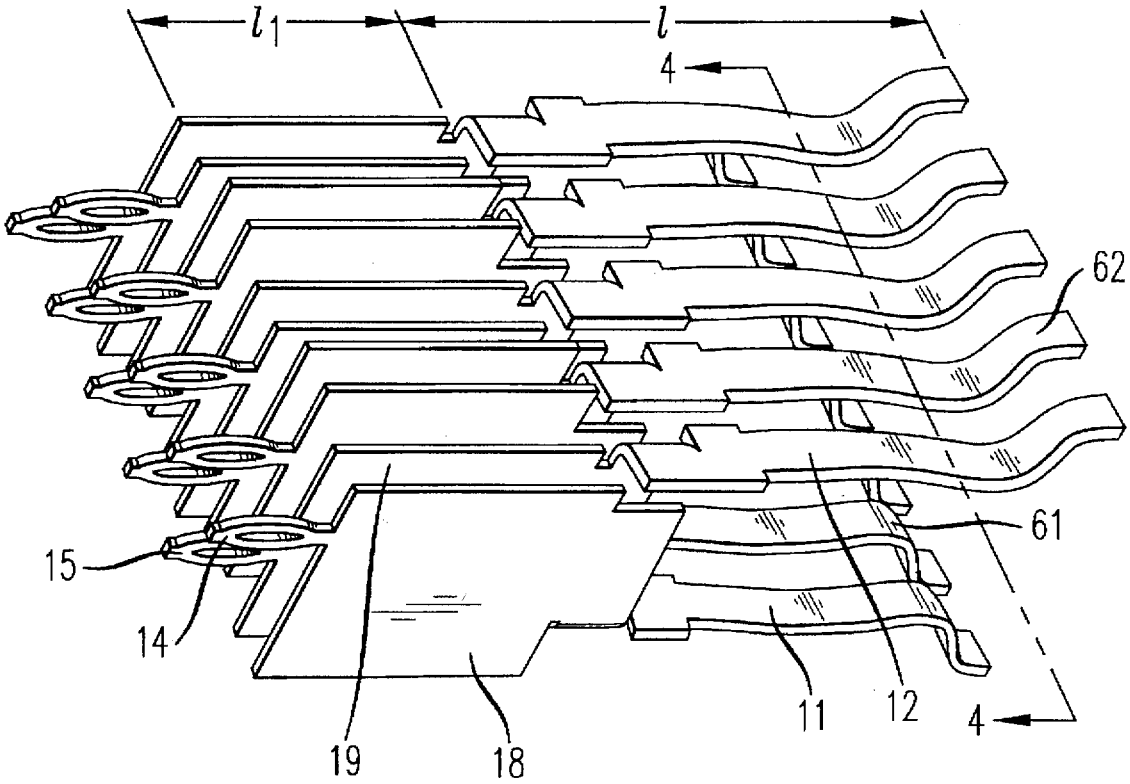
FIG. 3 is a perspective view of a plurality of conductor pairs in accordance with a further embodiment of the invention.
Figure 4:
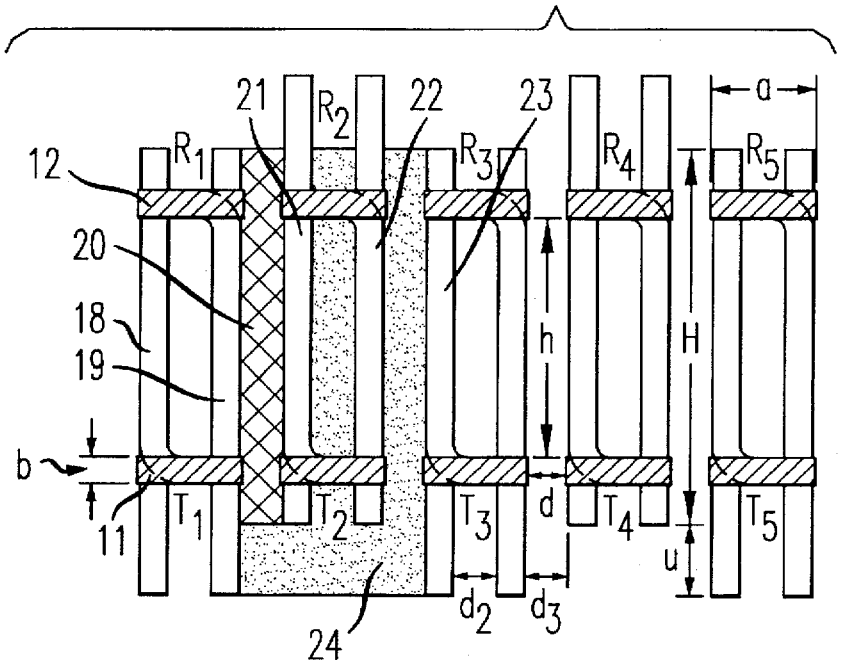
FIG. 4 is a cross sectional, partly schematic view taken along line 4—4 of FIG. 3.

FIGS. 3 and 4 illustrate another embodiment of the array of conductor pairs, with elements similar to those of FIGS. 1 and 2 being similarly numbered. In this embodiment, each vertical plate, e.g., 18 and 19, extends vertically past one of the conductors, e.g., 11 (or $T_1$), in the pair more than the other conductor, e.g., 12, in the pair by an amount u. Further, the plates are arranged in a staggered pattern so that the plates will extend more beyond a different conductor in adjacent pairs as shown. (For example, plates 21 and 22 will extend more beyond $R_2$ than $T_2$.) Thus, the vertical plates, as before, will provide capacitive coupling between unlike conductors, e.g., $R_1$ and $T_2$ (19 and 21), in adjacent pairs and also between unlike conductors, e.g., $R_1$ and $T_3$ (19 and 23), in the next adjacent pair. However, due to the staggering of the plates, the area of the capacitive coupling between the unlike conductors, $R_1$ and $T_3$, as illustrated by the speckled region, 24, in non-adjacent pairs will be greater than the area of coupling between the unlike conductors, $R_1$ and $T_2$, in adjacent pairs. This increased area can compensate for the greater distance between non-adjacent pairs and therefore provide greater opposite polarity crosstalk.

The following is an example of how a connector may be designed in accordance with the principles of the invention. The crosstalk in the mating section, 13, can be measured or calculated according to known techniques. For example, as an extension from the equations in Walker, Capacitance, Inductance and Crosstalk Analysis, (Anech House 1990) at pages 32–34, 51–53 and 101–102, the mutual capacitance unbalance, $C_{u1}$, and the mutual inductance, $L_{m1}$, between two conductor pairs, e.g., 11, 12 and 61, 62 of FIGS. 1 and 3, can be determined according to the following equations:

$$C_{u1}=\frac{\pi\epsilon_r\epsilon_0 l\ln[1+(h/d)^2]}{\ln\left[\frac{\pi d}{a+b}\right]\ln\left[\pi\frac{\sqrt{d^2+h^2}}{a+b}\right]} \quad (1)$$

$$L_{m1}=\frac{\mu_r\mu_0}{2\pi}\,l\ln\left(\frac{h^2+d^2}{d^2}\right) \quad (2)$$

where l is the length of each conductor from the edge of the mating section to the near end of the plate as shown in FIG. 3, $\epsilon_0$ is the dielectric constant of free space, $\epsilon_r$ is the relative dielectric constant of the intervening material (the encapsulant of FIG. 6), h is the vertical separation between conductors in a pair, e.g., 11 and 12, d is the horizontal separation between the conductors of the pairs, a is the width of the conductors, b is the thickness of the conductors, $\mu_0$ is the permeability of free space, and $\mu_r$ is the relative permeability of the intervening material.

It is known from Transmission Systems for Communications, fifth edition, written by Members of Technical Staff, Bell Telephone Laboratories (Bell Telephone Laboratories, Inc. 1982) pages 127–130, that if the transmission paths are short relative to the wavelength, and assuming equal source and load impedance, the near-end crosstalk $X_1$ induced on one pair by the other pair is then given by:

$$X_1=\frac{Z_0}{2}\left[\frac{j\omega Cu_1}{4}+\frac{j\omega L_{m1}}{Z_0^2}\right] \quad (3)$$

where $Z_0$ is the source or load impedance, assumed to be equal, and ω is the angular frequency of the applied signal.

The mutual capacitance unbalance, $C_{u2}$, and inductance, $L_{m2}$, between the two pairs in the section comprising the capacitor plates, e.g., 18, 19, 21 and 22, are given by:

$$C_{u2}=\epsilon_r\epsilon_0 Hl_1\left[\frac{1}{d_3}+\frac{1}{2d_2+d_3}-\frac{2}{d_2+d_3}\right] \quad (4)$$

$$L_{m2}=\frac{\mu_r\mu_0 l_1}{2\pi}\ln\left[\frac{(d_2+d_3)^2+u^2}{\sqrt{[(2d_2+d_3)^2+u^2][d_3^2+u^2]}}\right] \quad (5)$$

where H is the overlap height between the plates of adjacent pairs (note FIG. 4), $l_1$ is the length of each plate, $d_2$ is the spacing between plates within a pair, $d_3$ is the spacing between plates of adjacent pairs, and u is the offset between pairs in the embodiment of FIGS. 3 and 4. (Note u=0 in the embodiment of FIGS. 1 and 2).

The canceling near-end crosstalk, $X_2$ produced by the capacitor plates is then:

$$X_2=-\frac{Z_0}{2}\left[\frac{j\omega Cu_2}{4}+\frac{j\omega L_{m2}}{Z_0^2}\right] \quad (6)$$

where the minus sign indicates that this crosstalk is 180 degrees out of phase with the crosstalk produced in the mating section due to the fact that the plates capacitively couple unlike conductors in adjacent pairs.

Thus, $d_2$, $d_3$, H, u, $l_1$, and $\epsilon_r$ can be chosen so that the sum of $X_1$ and $X_2$ is essentially zero (i.e., the magnitude of the crosstalk produced by the plates is essentially equal to the magnitude of crosstalk in the mating section). In one example, the length, l, of the conductors was 0.0127 meters, the thickness, b, of the conductors was 0.000254 meters, the width, a, of the conductors was 0.001138 meters, the horizontal separation, d, between conductors in the mating section was 0.002159 meters and the vertical separation, h, between conductors was 0.003708 meters. A power sum crosstalk of approx 44 dB could be attained by choosing the separation, $d_2$, between plates of a pair as 0.000991 meters, the separation, $d_3$, between plates of adjacent pairs as 0.00066 meters, the overlap height, H, between plates of adjacent pairs as 0.008738 meters, the offset, u, as 0.001422 meters, the length, $l_1$, of each plate as 0.010668 meters, and $\epsilon_r$ as 3.7, which is the dielectric constant of a type of acetal resin (for example, Delrin™).

Figure 5:
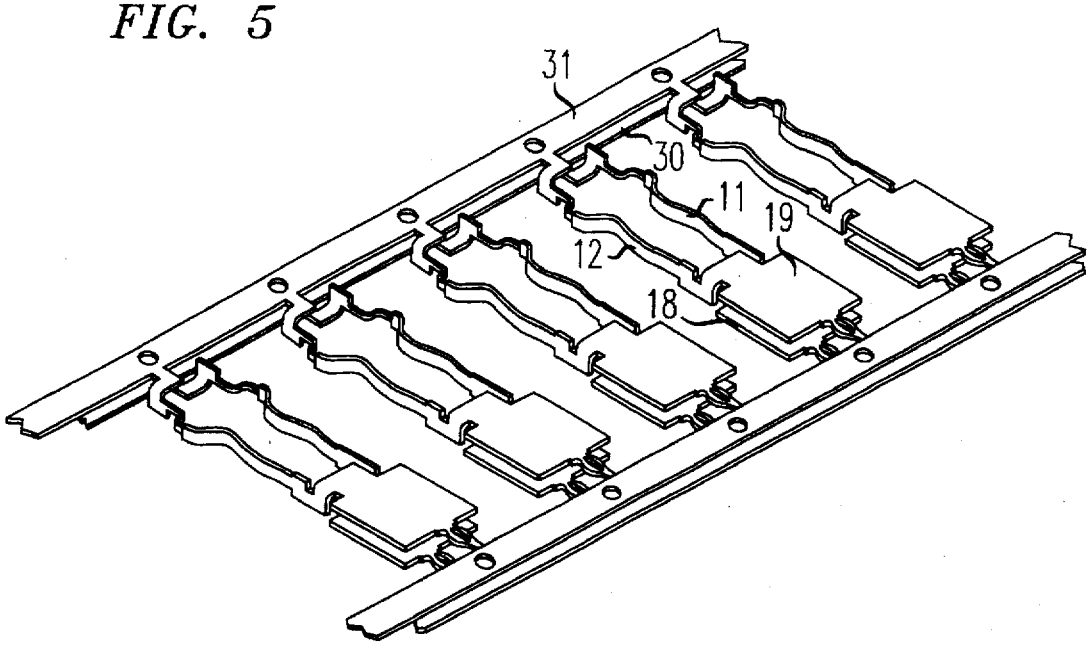
FIGS. 5–7 are perspective views of the conductor pairs and a connector housing during various stages of manufacturing a connector in accordance with the embodiment of FIGS. 3 and 4.
Figure 6:
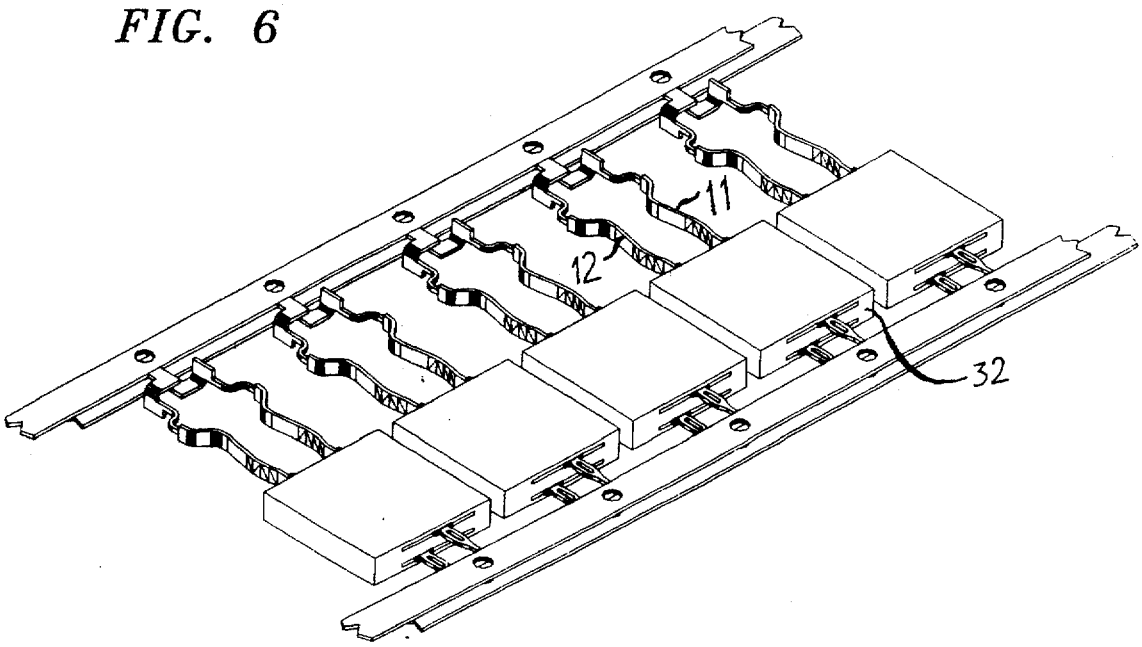
Figure 7:
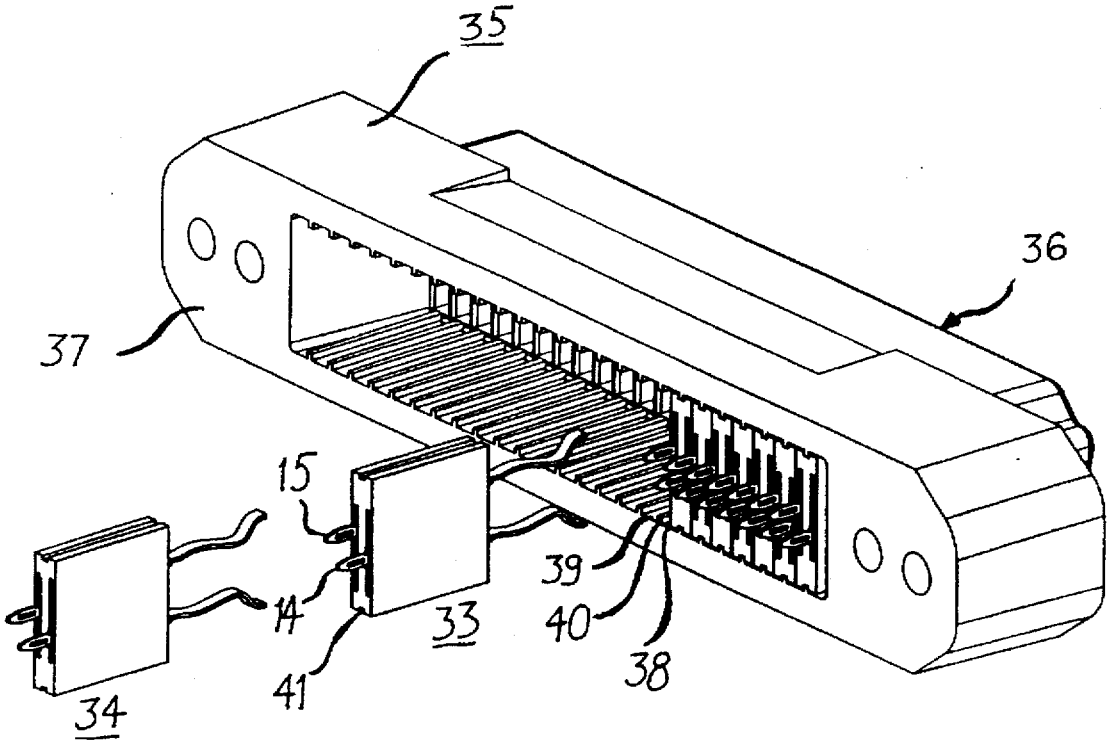

FIGS. 5–7 illustrate an example of the assembly of conductor pairs such as those shown in FIGS. 3 and 4 into a connector. As shown in FIG. 5, the conductors, e.g., 11 and 12, are formed as part of corresponding lead frames, 30 and 31, respectively, which are stacked one above the other as shown to form the conductor pairs while also aligning and fixing the separation between the capacitor plates, 18 and 19. As illustrated in FIG. 6, the plates, 18 and 19, of each pair are encapsulated in a dielectric material, 32, such as Delrin™ by standard molding techniques. The conductor pairs are then cut from the lead frames, 30 and 31, to form individual modules.

As shown in FIG. 7, these individual modules, e.g., 33 and 34, can then be inserted into a connector housing, 35. The housing, 35, includes a mating end, 36, for receiving a standard connector (not shown) such as a 25 pair cable connector, and a terminating end, 37, for connecting to a printed circuit board (not shown). Extending from an aperture in the terminating end, are a series of grooves, e.g., 38 and 39, separated by rails, e.g., 40. The rails receive corresponding grooves, e.g., 41, in the dielectric material of the module, 33, so that the modules are secured within the housing with the mating portions of the modules extending to the mating end, 36, of the housing, and the eyelets, 14 and 15, extending beyond the terminating end, 37. The staggering of the vertical plates, e.g., 18, 19, 21 and 22, of FIG. 4 can be accomplished by using identical modules, 33 and 34, but mounting adjacent modules at an orientation which is rotated 180 degrees.

Figure 8:
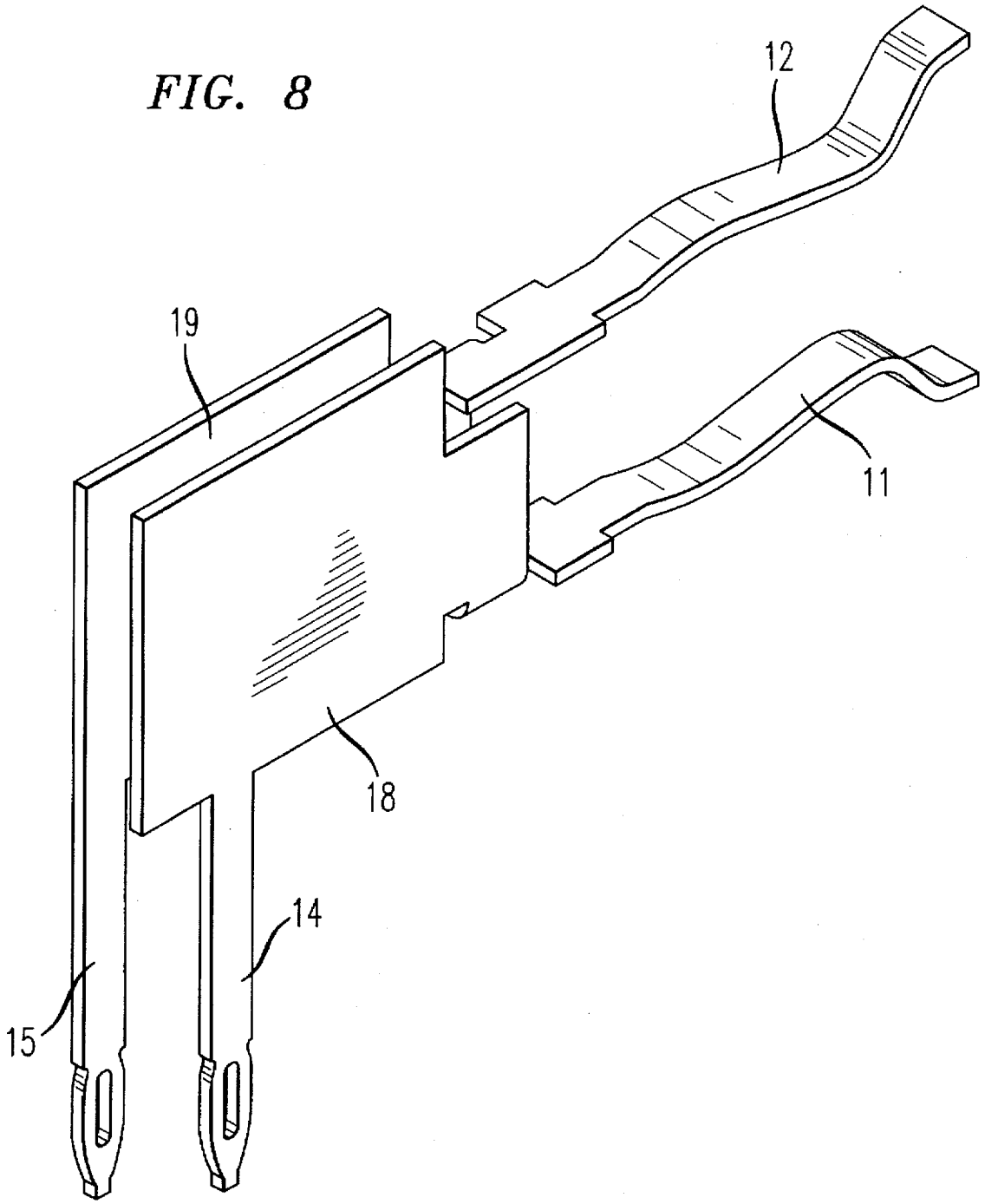
FIG. 8 is a perspective view of a conductor pair in accordance with a further embodiment of the invention.

FIG. 8 illustrates a further embodiment of a conductor pair, 11 and 12, which may be employed in the connector. It will be noted that the terminating tails 14 and 15, extend from the plates, 18 and 19, at an angle of approximately 90 degrees with respect to the conductors, 11 and 12. Thus, when the conductor pairs are mounted within the connector housing, 35 of FIG. 7, the mating portion can be oriented at 90 degrees to the board (not shown) in which the tails, 14 and 15, are inserted.

While the example of a board mounted connector is given, it will be appreciated that the terminating tails can be formed into cable termination ends so the connector can be attached to a cable. Further, the plates, e.g., 18 and 19, need not be integral with the conductors, e.g., 11 and 12. Rather, the plates could be formed on a plastic material or in slots in a printed circuit board which are electrically connected to the conductors.

The invention claimed is:

1. A connector comprising:

a plurality of pairs of first and second conductors arranged in vertically spaced rows, each pair including a mating section adapted for connecting to another connector so that the first and second conductors receive signals of opposite polarities, the first and second conductors in each pair being in spaced vertical alignment, and the first conductors in each pair being in horizontal alignment with first conductors in adjacent pairs and the second conductors in each pair being in horizontal alignment with second conductors in adjacent pairs, so that the mating section produces near-end crosstalk of a first polarity and first magnitude when signals are applied thereto;

conductive plates extending vertically from at least one conductor in at least selected pairs, the plate of a first conductor being spaced from the plate of a second conductor in an adjacent pair to provide capacitive coupling therebetween causing capacitive coupling unbalance between the two pairs when a signal is applied thereto in order to produce near-end crosstalk of a polarity which is opposite to that produced by the mating section.

2. The connector according to claim 1 wherein the opposite polarity crosstalk has a second magnitude which is essentially equal to the first magnitude.

3. The connector according to claim 1 wherein the plate of the first conductor is also spaced from a plate of a second conductor in a next adjacent pair to also provide capacitive coupling therebetween.

4. The connector according to claim 1 wherein the plates are integral parts of the conductors.

5. The connector according to claim 1 wherein the conductors further include a section for mounting the conductors to a printed circuit board.

6. The connector according to claim 1 wherein the connector further comprises a housing, and each conductor pair comprises a separate encapsulated module mounted within an aperture in the housing.

7. A connector comprising:

a plurality of pairs of first and second conductors arranged in a row, each pair including a mating section adapted for connecting to another connector so that the first and second conductors receive signals of opposite polarities, the first and second conductors in each pair being in spaced vertical alignment, and the first conductors in each pair being in horizontal alignment with first conductors in adjacent pairs and the second conductors in each pair being in horizontal alignment with second conductors in adjacent pairs, so that the mating section produces near-end crosstalk of a first polarity and first magnitude when signals are applied thereto;

conductive plates extending vertically from at least one conductor in at least selected pairs, the plate of a first conductor being spaced from the plate of a second conductor in an adjacent pair to provide capacitive coupling therebetween causing capacitive coupling unbalance between the two pairs when a signal is applied thereto in order to produce near-end crosstalk of a polarity which is opposite to that produced by the mating section, wherein the conductive plates in each pair extend vertically past the conductors and the plates extend more past alternate ones of the conductors in alternate pairs.

* * * * *